US005149488A

United States Patent [19]

Dickson, deceased

[11] Patent Number: 5,149,488

[45] Date of Patent: Sep. 22, 1992

[54] APPARATUS AND METHOD FOR SPILL CHILLING RAPIDLY SOLIDIFIED MATERIALS

[75] Inventor: James Dickson, deceased, late of Stirling, N.J., by Jacqueline T. Dickson, executor

[73] Assignee: Dickson Enterprises, Inc., Stirling, N.J.

[21] Appl. No.: 500,365

[22] Filed: Mar. 28, 1990

[51] Int. Cl.[5] ..... B22D 11/06

[52] U.S. Cl. ..... 266/242; 266/200

[58] Field of Search ..... 164/423, 463, 485, 486, 164/487; 266/242, 200, 259; 148/125

[56] References Cited

U.S. PATENT DOCUMENTS

| | | | |
|---|---|---|---|
| 4,093,553 | 6/1978 | Galey et al. | 148/125 |
| 4,157,729 | 6/1979 | Patton et al. | 164/463 |
| 4,257,830 | 3/1981 | Tsuya et al. | 164/463 |
| 4,562,878 | 1/1986 | Lewis | 164/463 |
| 4,582,116 | 4/1986 | Ray et al. | 164/463 |
| 4,813,472 | 3/1989 | Hackman et al. | 164/463 |
| 4,913,220 | 4/1990 | Dickson | 164/463 |

FOREIGN PATENT DOCUMENTS

| | | | |
|---|---|---|---|
| 0156863 | 9/1982 | Japan | 164/463 |
| 0119354 | 6/1986 | Japan | 164/463 |

*Primary Examiner*—Scott Kastler
*Attorney, Agent, or Firm*—Michael J. Weins

[57] ABSTRACT

The present invention is for a device for rapidly solidifying a material and a method of using the same. The device provides for containing a molten pool of material in a solid skull with the same composition as the molten material. The skull is preferably held in a cavity of an inductor which is heated by an induction coil. Means are provided to maintain a small temperature gradient in the skull so as to minimize segregation which can lead to compositional fluctuations. It is preferred that the minimum temperature in the skull is between about 0.7 and 0.95Tm, where Tm is the melting or solidus temperature of the material.

Feed means provide material to the molten pool causing it to spill over onto a moving chill surface. Preferably the chill surface is cooled by a molten stream of liquid gas.

15 Claims, 5 Drawing Sheets

200
202
204
206
208
210
212
214
216
217
218
222
224
226
228
230
232
234
236
238
240
242
244
LIQUID GAS
$H_2O$
$H_2O$
D
d 400
402
404
406
408
410
LIQUID GAS
412
414
416
418
420
D
d
$H_2O$
$H_2O$

APPARATUS AND METHOD FOR SPILL CHILLING RAPIDLY SOLIDIFIED MATERIALS

FIELD OF INVENTION

The present invention relates to an apparatus for producing rapidly solidified materials and to a method using the apparatus.

BACKGROUND ART

Rapidly solidified materials are formed by cooling materials so rapidly the kinetic processes responsible for the structure and/or phase distributions associated with prior art commercially produced materials are suppressed. The structure of rapidly solidified materials may be amorphous, microcrystalline or a combination thereof. Because of the fine structure and the suppressed phase transformations, many rapidly solidified materials have improved magnetic, electric, mechanical and/or corrosion properties when compared to materials of the same chemistry produced using conventional prior art techniques.

The demand for rapidly solidified materials has grown as their unique properties are identified and components are designed to utilize these properties. Because of the improvement in electrical and magnetic properties, motors, generators and transformers smaller in size, yet having equivalent or better performance than their conventional counter parts can be made through the appropriate utilization of components made from, or coated with, rapidly solidified materials. Because of increased corrosion resistance, parts with sharp edges, and which are more resistant to corrosive environments, can be formed and made from rapidly solidified materials or materials coated with rapidly solidified powders.

Although the applications for amorphous and microcrystalline materials have grown significantly in the past decade, the methods of manufacturing such materials has not kept pace. Most rapidly solidified materials are made by a process such as is taught in U.S. Pat. No. 4,389,258 of Dickson et al. entitled METHOD FOR HOMOGENIZING THE STRUCTURE OF RAPIDLY SOLIDIFIED MICROCRYSTALLINE METAL POWDERS. The '258 patent teaches a process whereby molten metal is jet cast onto a chill surface. FIG. 3 of the '258 patent shows a jet caster which includes a quartz crucible with a bottom nozzle. An alloy is melted in the quartz crucible and pressure forces a stream of the molten metal through the nozzle onto the periphery of a rotating chilled wheel.

U.S. Pat. No. 993,904 of Edward Halford Strange, entitled APPARATUS FOR MAKING METAL STRIPS, FOIL, SHEETS OR RIBBONS teaches a device for maintaining a constant level of molten metal in a vessel which is located in close proximity to a moving cylinder. The vessel is provided with an overflow having a length equal to the width of the strip, sheet or ribbon which is to be produced. Metal overflows from the vessel onto a rotating cylinder.

The present invention is directed to a spill chill process for producing rapidly solidified materials. Using the equipment and method of the present invention, materials with widely varying chemistries, melting temperatures and reactivity can be rapidly solidified. Furthermore, the present equipment and method increases the efficiency and reliability with which rapidly solidified materials can be produced.

Using the present invention, rapidly solidified materials can be produced from feed materials having different melting points, different thermal conductivities and different electrical properties.

The present technique produces the rapidly solidified amorphous materials and does so through the unique creative application of an improvement on the technology taught in the 1911, '904 patent.

SUMMARY OF INVENTION

It is an object of the present invention to provide an apparatus and a method for producing rapidly solidified materials from high melting point materials.

It is an object of the present invention to provide a method and the apparatus for producing rapidly solidified materials from reactive materials.

It is an object of the present invention to provide a method and the associated equipment for producing rapidly solidified ribbon or filament.

It is an object of the present invention to provide a method and the associated equipment for producing rapidly solidified shard.

It is an object of the present invention to provide a method and the associated equipment for producing rapidly solidified powder.

It is an object of the present invention to provide the equipment and associated apparatus for producing rapidly solidified amorphous ribbon, the width of which can be varied at the discretion of the operator.

It is an object of the present invention to provide equipment which can simultaneously produce ribbons of different width utilizing a single casting wheel.

It is an object of the present invention to provide equipment which can be used to rapidly solidify nonmetallic materials.

It is an object of the present invention to produce rapidly solidified materials with a minimum of segregation.

It is an object of the present invention to provide equipment which can be utilized to produce rapidly solidified materials using stock material that does not have high electrical conductivity.

It is an object of the present invention to provide equipment and the associated method for producing rapidly solidified materials from stock material that does not couple with an induction coil.

It is yet another object of the invention to provide equipment that, with minor modifications can be used to produce shard, ribbon or fine powder.

It is yet another object of the invention to provide equipment which can be used to produce rapidly solidified material from stock material that has a relatively high melting point.

It is still another object of the invention to provide a casting wheel which can be used to produce multiple amorphous ribbon segments.

A further object of the present invention is to provide a casting surface which is directly cooled.

It is an object of the present invention to provide equipment and a method for rapidly solidifying material in an inert atmosphere or in a vacuum so as to avoid atmospheric contamination of the material.

Another object of the invention is to prevent crucible contamination by providing rapid solidification equipment which will allow the feed material to be melted in a skulled crucible.

These and other objects of the present invention will become apparent from the following descriptions, figures and claims.

The present invention is directed to a method and the associated apparatus for producing rapidly solidified materials. The apparatus of the present invention provides for the melting and forming of rapidly solidified materials from feed stock. The feed stock can have a variety of forms, including solid, powder, powder compact or liquid.

The feed stock is heated on a support surface or in a support container. At one end of the container or support surface the material is heated to a temperature above the melting point of the feed stock. Melted material is spilled onto a quenching surface. The quench or chill surface is maintained at a sufficiently cool temperature so that the material spilled on the surface will be rapidly solidified.

In a preferred embodiment, a casting wheel or a continuous belt is used for the chill surface.

In yet another preferred embodiment the chill surface is contoured to conform to the shape of the crucible from which molten material is spilled. When molten material is spilled from the contoured lip of a crucible onto a contoured chill surface preferably the spill depth along the width of the chill surface is approximately constant. By maintaining an equal spill distance, rapidly solidified material having uniform amorphous or microcrystalline structure and uniform thickness can be produced.

A support surface, or a support container, is provided for the feed material. The form and structure of the support surface is in part a function of the composition and form of the feed stock. When the feed stock is in the form of a solid billet, a simple one dimensional support surface can be used, however, if the feed stock is either a powder or a liquid an appropriate container must be used. Care should be taken in selecting the support surface to assure that interaction between the heated feed stock and the support surface does not occur.

In one preferred embodiment the support surface is an inductor with a cavity at one end which serves as a crucible for containment of the feed material.

Since the feed stock material will be at a temperature near the melting point at the end of the support surface in closest proximity to the chilled surface, a material resistant to elevated temperature oxidation must be used if the apparatus is operated at an elevated temperature in an environment where there is an oxidation potential.

Further, when feed stock will move relative to the support surface so as to supply material to the chill surface, the support surface should have a low coefficient of friction with respect to the feed stock.

The heating means, which vary depending on the character of the feed stock, are provided for locally and globally heating the feed stock. Resistant heaters, induction heaters, as well as directed energy beams such as plasma, laser and electron beams are appropriate heating means within the scope of the invention.

Means for monitoring and controlling the temperature of the feed stock are provided. The monitoring means will depend on the material and the temperature and maybe a thermocouple placed at the interface between the feed stock and the support surface, or an optical or infrared pyrometer.

The temperature of the feed stock is preferably maintained between about 0.7 to 0.95 Tm, where Tm is the solidus temperature.

Optionally, water cooling coils are provided to the support surface to extract heat and to provide for more precise control of the temperature and to aid in skull melting.

Alternatively, if the feed material is supported by an inductor having a cavity serving as a crucible, then the water cooling can be accomplished with a water cooled crucible configured to accept the inductor.

A focused energy source, such as an electron beam, laser beam, ion beam or an electric or plasma arc, can be used to locally heat the feed stock. Local heating can be used for skull melting. Skull melting has an advantage if the feed stock is a reactive material since by locally heating and forming a confined liquid pool, the liquid stock material is in contact only with material of the same chemistry. Thus a reaction between a reactive feed stock and a support structure of a different material will be avoided.

The present method requires that molten feed stock be spilled onto a moving chill surface. The moving chill surface can be in any of a variety of forms, including a continuous belt or the rim of a rotating wheel. The chill surface should be both mechanically and electrically insulated to avoid electrical or vibrational transfer from the molten pool of feed material. Electrical isolation is crucial in the event that the heating source results in producing a current.

In a preferred embodiment, means for advancing the pool so that molten metal will continuously spill onto the moving chill surface are provided. Optionally gravity feed can be used to spill molten material onto the chill surface.

It is preferred that the chill surface be cooled and it is further preferred that cooling be provided by a liquid coolant which is directed onto that portion of the surface which is prior to but in close proximity to the position of the chill surface onto which the spilled material impacts.

Prior to is defined with respect to the movement of the chill surface and the spilling material. Prior to refers to a position that will, by the movement of the surface, be advanced towards the spilling material.

Preferred configurations for the chill surface of the present invention are a large diameter wheel having a contoured rim or a continuous belt contoured to conform to the crucible.

Preferred materials for the chill surface are high conductivity materials such as copper, aluminum, cast iron and noble metal coated substrates. The material selected for the chill surface will depend on the form of the rapidly solidifying material that is to be produced and on the chemistry and temperature of the feed material.

In one preferred configuration the wheel is formed of a series of co-axial wheel segments, such wheel segments varying slightly in diameter so that the profile of the circumference of the wheel has a step contour.

In a further preferred embodiment of the present invention wheel segments having different thicknesses can be assembled and disassembled. By assembling different thickness wheel segments together, shard or ribbon of different widths can be made using the same equipment in different casting operations.

In another preferred embodiment the belt has a series of transverse barriers. The transverse barriers form short length shard segments and provide additional chilling to the molten material.

In another preferred embodiment of the present invention a continuous belt having side dams is provided, along with a rotating wheel that is internally cooled by water and in addition cooled by a jet of liquid gas which impacts the surface at a point prior to the point at which the spilled material contacts the chill surface.

BEST MODES OF CARRYING THE INVENTION INTO PRACTICE

Figure 1:
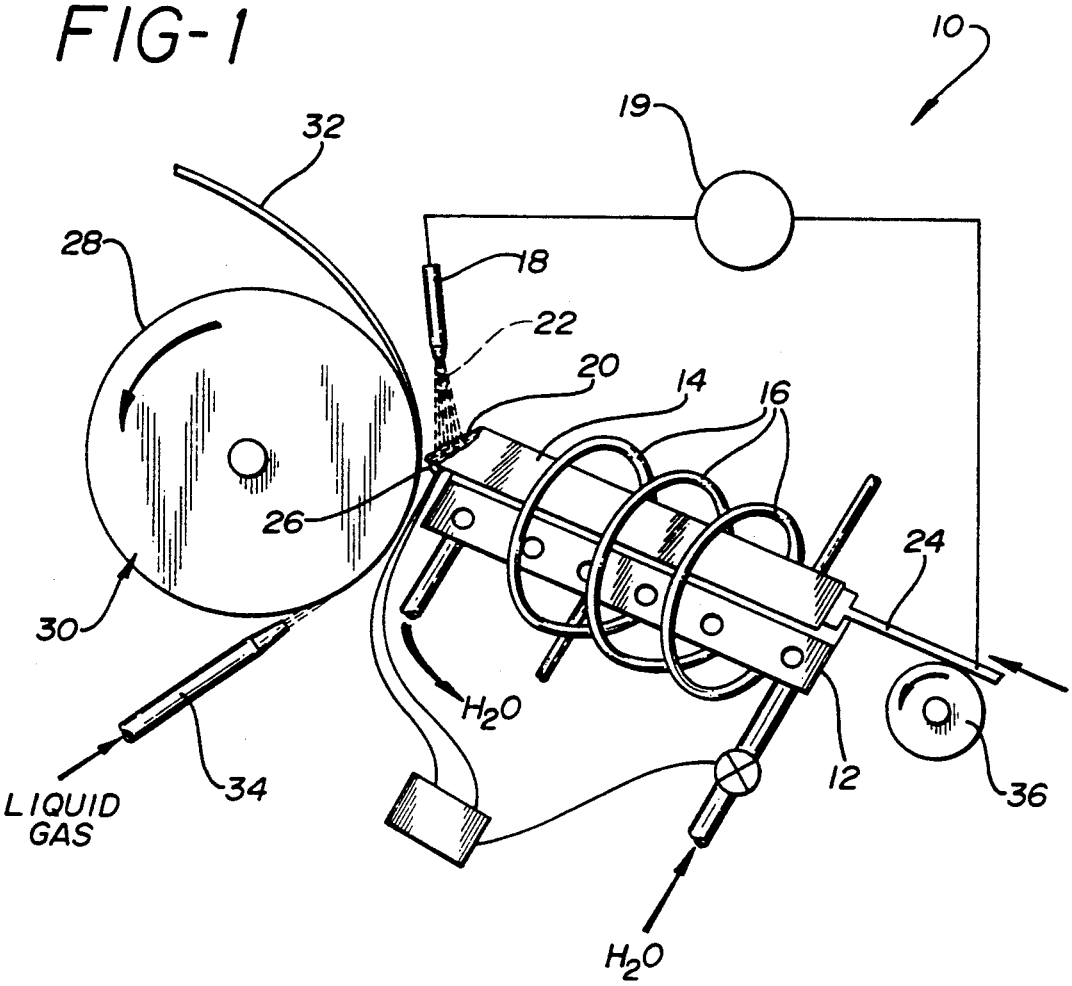
FIG. 1 is a schematic representation of one embodiment of the present invention in which metal, ceramic, polymer, bulk solid or powder feed material is globally heated and locally melted. The feed material is advanced at a rate such that the molten materials solidify on a rotating wheel that is internally cooled by water and in addition cooled by a jet of liquid gas. The liquid gas impacts the surface at a point prior to the position at which the spilled material contacts the chill surface.

FIG. 1 is a schematic representation of one embodiment of the present invention. The spill chill equipment 10 is provided with a support surface 12. The support surface 12 cradles the feed material 14. Means such as resistance heaters and induction heating coils 16 provide for globally heating the solid feed material 14.

Global heating means heat the solid feed material to between about 0.7 and 0.95 of the melting or solidus temperature, Tm. The use of global heating means to maintain the solid feed material at a temperature between 0.7 and 0.95 Tm minimizes the fluctuations in temperatures in the solid and thereby assures more uniform properties of the resulting rapidly solidified material avoiding segregation along the liquid solid interface of the skull and locally melted material to be spilled.

A local energy source 18 is employed to locally raise the feed stock temperature above Tm and thus provide a molten pool 20. The local energy source can be an arc torch, an arc plasma torch, a laser or an electron beam.

If an arc source 18 as shown in FIG. 1 is used an arc 22 is struck and maintained between the molten material 20 and the arc source 18. A second electrical contact 24 provides a path through the solid feed material 14 for the current flow or through the conductor support 12. Current flow through the feed material provides for $I^2R$ heating of the solid feed material 14 or conductive or radiate heating of 14 by the current through the conductive support 12.

In order to assure that the temperature at the interface between the solid feed material 14 and the support surface 12 is maintained at 0.7 to 0.95 Tm, a thermocouple 26 is placed in contact with the surface of the solid feed material 14 near the interface 28 between the feed material 14 and support surface 12.

The thermocouple 26 serves as a control means to assure that the solid material 14 is maintained at a temperature between 0.7 and 0.95 Tm. So maintaining the temperature of the feed stock assures a sharp interface between the molten material 20 and the solid portion of the feed stock 14. The small temperature differential at the interface will remain stable and thus short term fluctuations in temperature at the liquid solid interface will be minimized.

The molten pool of material 20 is spilled into contact with the circumferential rim 28. The spilled material is rapidly solidified by the rim 28 of the chilled wheel 30 to a rapidly solidified ribbon 32.

With respect to materials copper and copper alloys and in particular OFHC Copper and Copper alloys containing chromium, titanium, zirconium and/or beryllium are preferred. Also preferred are other high thermal conductivity oxidation resistant noble materials such as TMZ molybdenum, chromium alloys steel and stainless steel. If corrosion or oxidation is not a problem a cast iron wheel can be used because of the high thermal conductivity and thermal mass of cast iron. If corrosion is a problem tool steels and nickel or cobalt alloys can be used. The wheel and/or belt can be formed by coating a material having high thermal conductivity and thermal heat capacity with a material that is noble relative to material that is to be spill chilled.

Since the heat is supplied to the rim 28 during rapid solidification, the most effective way of cooling the rim is through direct cooling of the rim 28. Preferably this is accomplished by spraying a liquid gas, such as liquid nitrogen, directly onto the rim 28. A nozzle 34 or series of nozzles are used to direct the liquid gas onto the rim 28. The nozzles should be placed to direct the liquid gas as close to the point at which material was spilled onto the wheel as practical. In one preferred nozzle configuration a jet of liquid gas impacts the surface at a point prior to the point at which the spilled material contacts the chill surface. Prior to refers to a position that will by the movement of the surface be advanced towards the spilled material. Alternatively the liquid gas can be injected onto the wheel at the point where the ribbon moves away from the wheel, thereby increasing the stripping capacity of the wheel. This gives flexibility with respect to the form of the rapidly solidified material since the liquid gas, when heated, will expand rapidly and cause either gas bubbles to break up the rapidly solidified material or alternatively may cause the rapidly solidified material to float on a vapor layer formed from rapidly heating the liquid gas. The liquid gas assures cooling of the rim 28 while entrapped gas on the surface may cause a discontinuous ribbon shard 32 to be generated. If a rapidly solidified powder is desired the judicious placement of the liquid gas nozzle in combination with a serrated or grooved wheel can be used to form rapidly solidified shard and/or powder. This will reduce the requirement for pulverization of the rapidly solidified ribbon subsequent to production.

The liquid gas will volatilize and aid in shielding the entire system along with the gas introduced, if an arc plasma created energy beam is present. The fluids of the volatilized cooling gas may act in the grooves of an etched wheel to form tapes or filaments.

As the molten pool 20 spills onto the moving rim 28, it will be necessary to advance the solid feed material 14. The solid feed material 14 can be advanced manually or by a motor and gear mechanism 36.

In place of the rim of a rotating wheel a continuous belt can be used or alternatively, the circumferential area of a flat rotating surface could be used.

Figure 2:
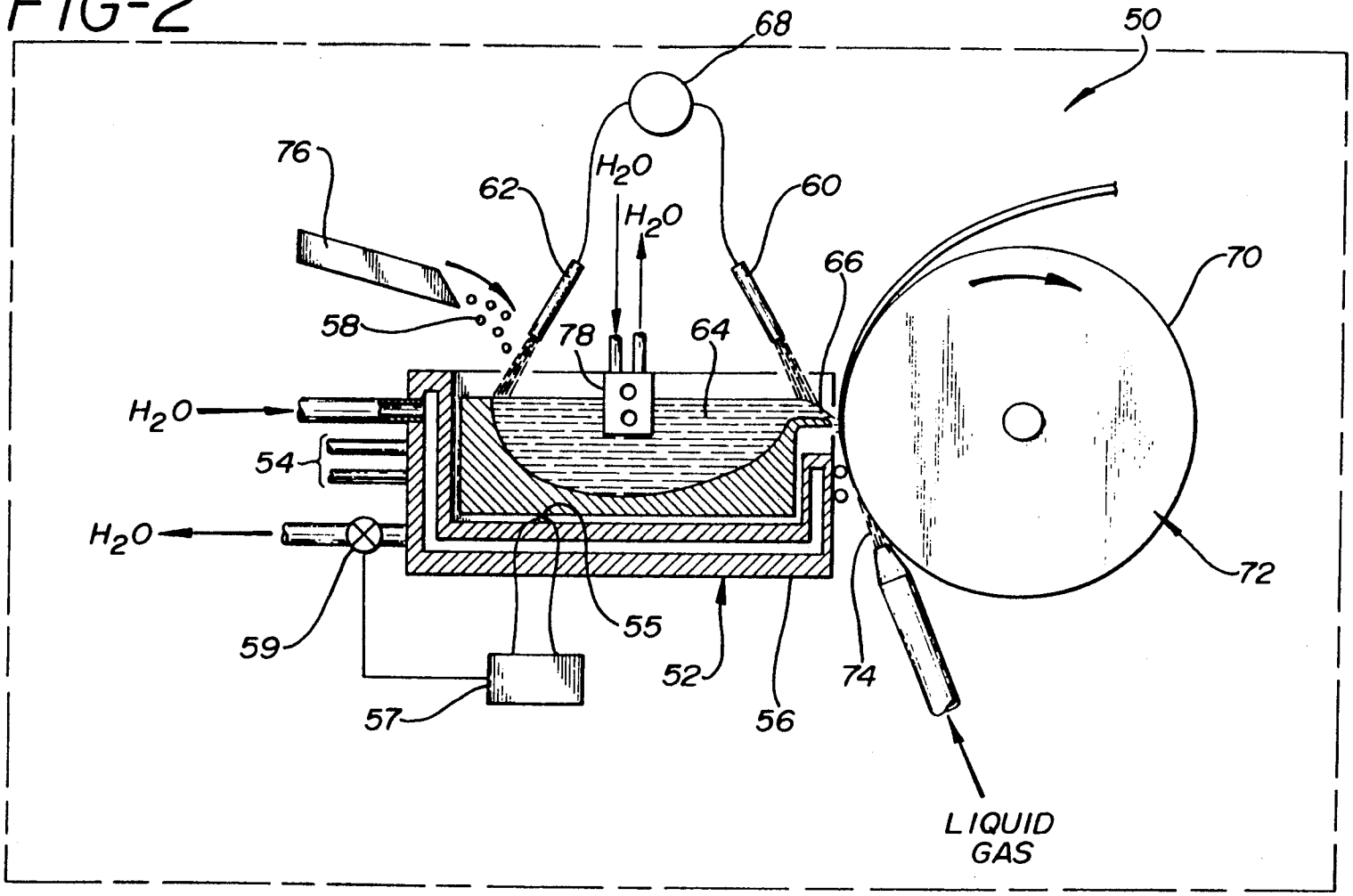
FIG. 2 is a schematic representation of a second embodiment of the present invention. In this embodiment a pool of molten feed material is formed in a skull. Molten material contained in the skull spills onto the rim of a moving chilled wheel. The molten pool may be fed by solid or liquid material.

FIG. 2 is a schematic representation of a second embodiment 50 of the present invention. In this embodiment the support for solid material is a controlled temperature containment vessel 52. The containment vessel 52 comprises an induction heating unit 54 and water cooled crucible 56. A thermocouple 55 can be used to measure the temperature of the metal crucible interface. The output of the thermocouple 55 is fed to a control circuit 57. The control circuit 57 controls the flow through valve 59. Feed material 58 is placed in the crucible 56.

Local heating is provided by two or more electrodes, a first electrode 60 and the secondary electrode 62 which are arc torches and create a molten pool 64. The first electrode 60 makes electrical contact with the feed material 58 melting it to form pool 64 for spilling at a spill lip 66. The secondary electrodes 62 makes electrical contact with the feed material 58 at a distance from the spill lip 66 and applies heat to feed material from hopper 76. A power source 68 is provided for producing a current or arcs. The contour of the molten pool 64 can be altered by movement of the electrodes 60 and 62. The moving surface 70 is the rim of a chilled wheel 72. The rim is cooled by jet 74 of liquid gas such as nitrogen, helium and argon which is directed to the rim 70. The liquid gases could also be applied to other moving chill surfaces such as belts or a spinning dish or dishes.

As material from the molten pool 64 spills onto the rim the material is rapidly solidified and removed. In a preferred embodiment, in order to avoid contamination of the feed material and/or the rapidly solidified product, the entire apparatus can be maintained in a controlled atmosphere by enclosing the casting apparatus in a vessel which is indicated by the phantom line.

Feed material 58 is replenished by use of a hopper mechanism for solid or liquid feed 76. The hopper is provided with control means which regulate flow of material into the crucible. The control means can preferably be connected by means of a level switch which monitors the level of the molten pool 64 in the crucible 52. A dam 78 is provided to mitigate turbulence at the spill interface. If the material which is being rapidly solidified has a tendency to oxidize or otherwise pick up scum or dross the dam can minimize the tendency of the dross to flow into the region of spill.

Figure 3:
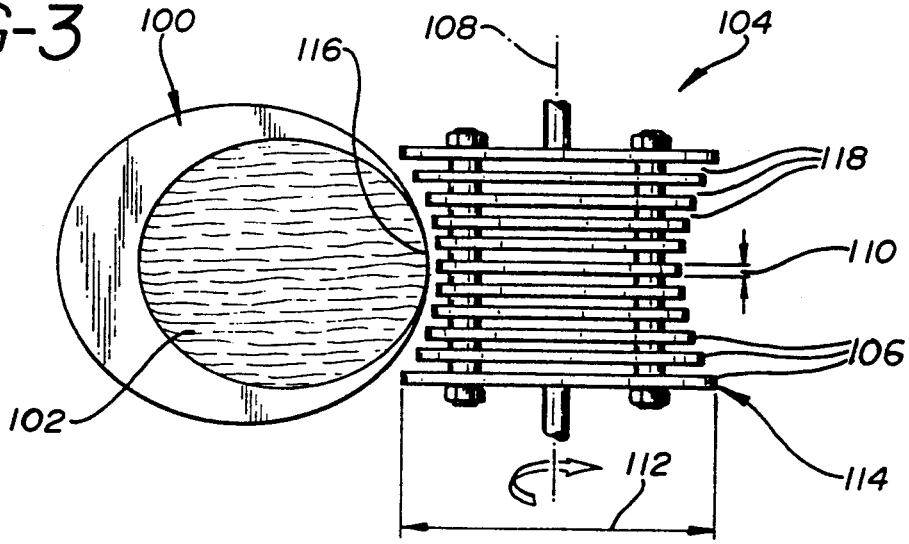
FIG. 3 is a schematic representation of a preferred chilling wheel in accordance with the present invention having a profile contoured to match the contour of the crucible from which the molten metal is spilled.

FIG. 3 is a schematic representation of a crucible 100 which spills liquid 102 onto a preferred casting wheel 104 in accordance with the present invention. The casting wheel 104 is constructed of a series of discs 106 which are concentrically stacked about a common axis 108. The discs 106 are arranged by thickness 110 and diameter 112 so as to form a casting wheel 104 having a profile 114 which matches the contour of the lip 116 crucible 100. By forming a casting wheel from disc shape segments a wheel contoured so as to conform to the lip 116 of the crucible supplying the molten metal can be formed. Using the contoured wheel 104 of FIG. 3 in combination with insulating spacers at the interface 118 between the discs allows a series of side by side ribbons to be cast. This product form is of particular advantage when the final product is to be powder.

Figure 4:
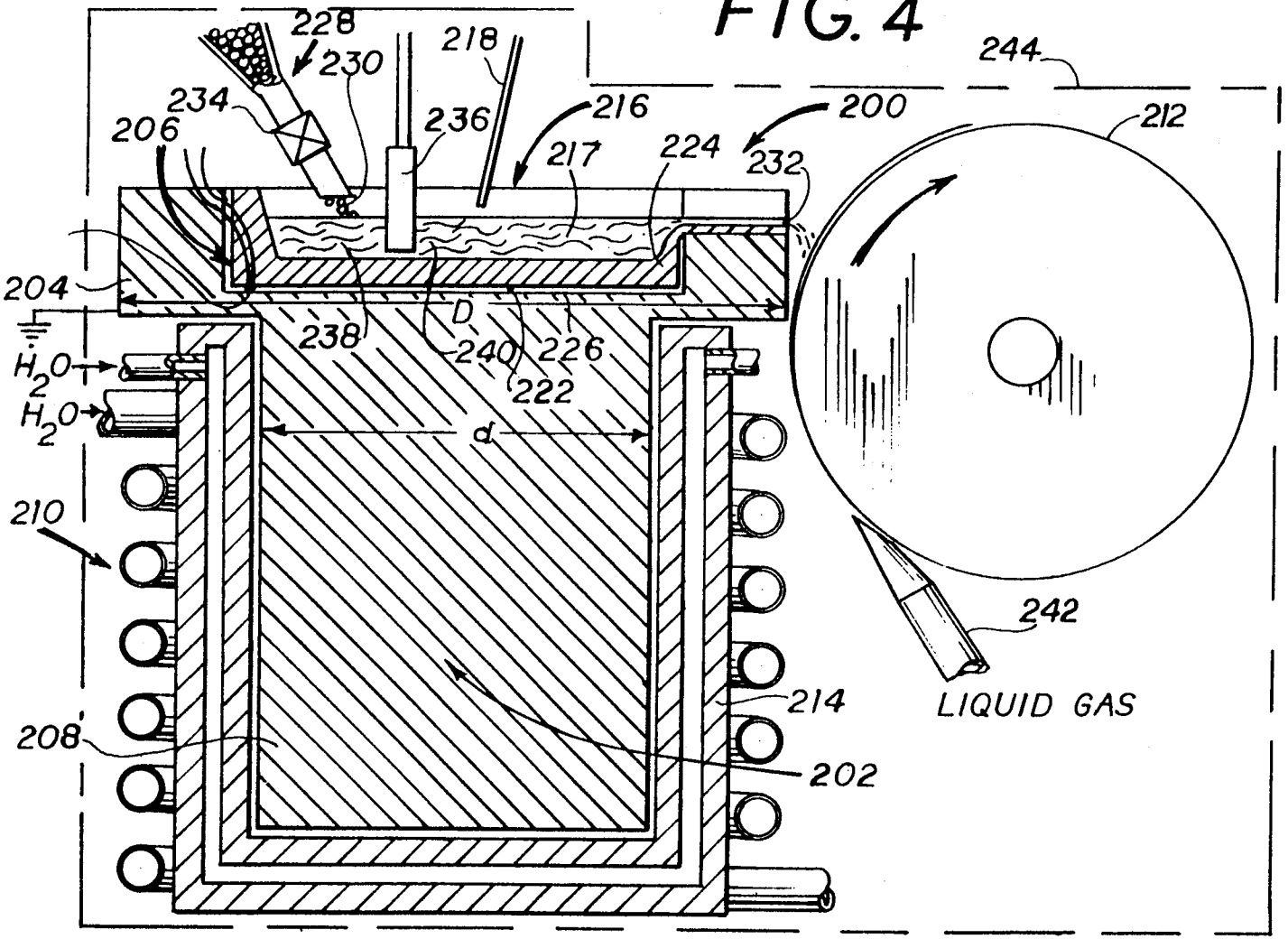
FIG. 4 is a schematic representation of a preferred device for spilling molten metal contained in a skull which is maintained in a cavity in an inductor. This device also employes a cooled wheel onto which the molten metal is spilled.

FIG. 4 illustrates another embodiment of the present invention where solid feed material is supplied to a molten pool which causes the pool to spill onto a moving chill surface. The casting device 200 has an inductor 202 which has a first section 204 with a cavity 206 which serves as a crucible in which a skulled melt is maintained. The inductor 202 has a second section 208 which is surrounded by an induction coil 210. The first section 204 of the inductor 202 preferably had a diameter D which is larger than the diameter d of the second section 208 of the inductor 202. It is preferred that the diameter D of the first section 204 is greater than or equal to the outer diameter of the induction coil 210. The induction coil 210 being so sized assures that a moving chill surface 212 can be brought into close proximity with the first section 204 of the inductor 202 while being spaced apart from the induction coil 210 to minimize interactions between the induction coil 210 and the chill surface 212 and any radiational heating of the chill surface 212 by second section 208 of the inductor 202.

To further reduce radiational heat transfer between the inductor 202 and the moving chill surface 212 it is preferred that the inductor 202 is positioned in a crucible 214. It is further preferred that the crucible be water cooled to dampen fluctuations in the temperature profile of the inductor 202.

The crucible 206 contains a solid charge 216 of feed material port of the charge is maintained molten, forming a contained molten pool 217 by a focused energy source 218. Preferred focused energy sources are arc torches, gas torches, plasma arc torches, electron and ion beams, and lasers. The casting device 200 shown in FIG. 4 employes an arc plasma torch. The inductor is electrically conductive and grounded to provide conducting path between the plasma torch 218 and the molten pool 217 needed to maintain a plasma. Preferred materials for the inductor are graphite and metals, such as steel or copper. When metal inductors are employed it is preferred that a ceramic wash be applied to the surface of the crucible 206 to avoid fusion between the solid charge 216 and the inductor 202. When a ceramic wash is employed then the solid feed material 216 should be grounded to assure a conductive path.

Means are provided to monitor and control the temperature of the solid charge 216 to assure that a minimum temperature is maintained at between 0.7 and 0.95 Tm. This is preferably accomplished in the device 200 by placing a thermocouple 220 to monitor the temperature at the interface 222 between the solid skull 224 and the surface 226 of the crucible 206. The temperature at the interface 222 can be maintained constant by adjusting the power supply to the induction coil 210. The temperature control can be automated by employing a controller which is responsive to the thermocouple 220 and adjusts the power to maintain the temperature at the interface within the specified limits.

Means for providing feed stock 228 to the molten pool 217 are provided in FIG. 4 where a hopper is employed. The stock is supplied in the form of solid charge particles 230. The feed stock 228 supplied raises the level of the molten pool 217 and results in the molten pool 216 overflowing the crucible 206. To provide a directed spillage, a spout 232 is provided that directs the spilled metal onto the moving chill surface 212.

One simple form of control for the feed stock is to have a metered time during which feed material is input to the molten pool 217. This can also be accomplished by providing a valve 234 which is opened and closed, thus regulating the input of charge particles 230.

Preferably a dam 236 partitions the molten pool 217 into a first section 238 and second section 240. The charge particles 230 are fed into the first section 238 of the molten pool 217 and restrained from moving into the second section 240 by the dam 236. The dam 236 also damps disturbances in the molten metal pool 217 that result from introduction of the solid charge particles 230 to the molten pool 217, thus providing for a more controlled spillage.

It is further preferred that the moving chill surface 212 be cooled to dissipate the heat which is extracted from the molten metal which is spilled on the moving chill surface 212. As discussed above a nozzle 242 is preferably employed to provide liquid gas to the moving chill surface 212 which cools the surface and provides a gaseous shield to the metal being spilled onto the moving chill surface 212.

Preferably the casting device 200, the hopper 228 and the casting surface 212 are contained in a vessel 244 so that the casting can be done in a controlled atmosphere.

Figure 5:
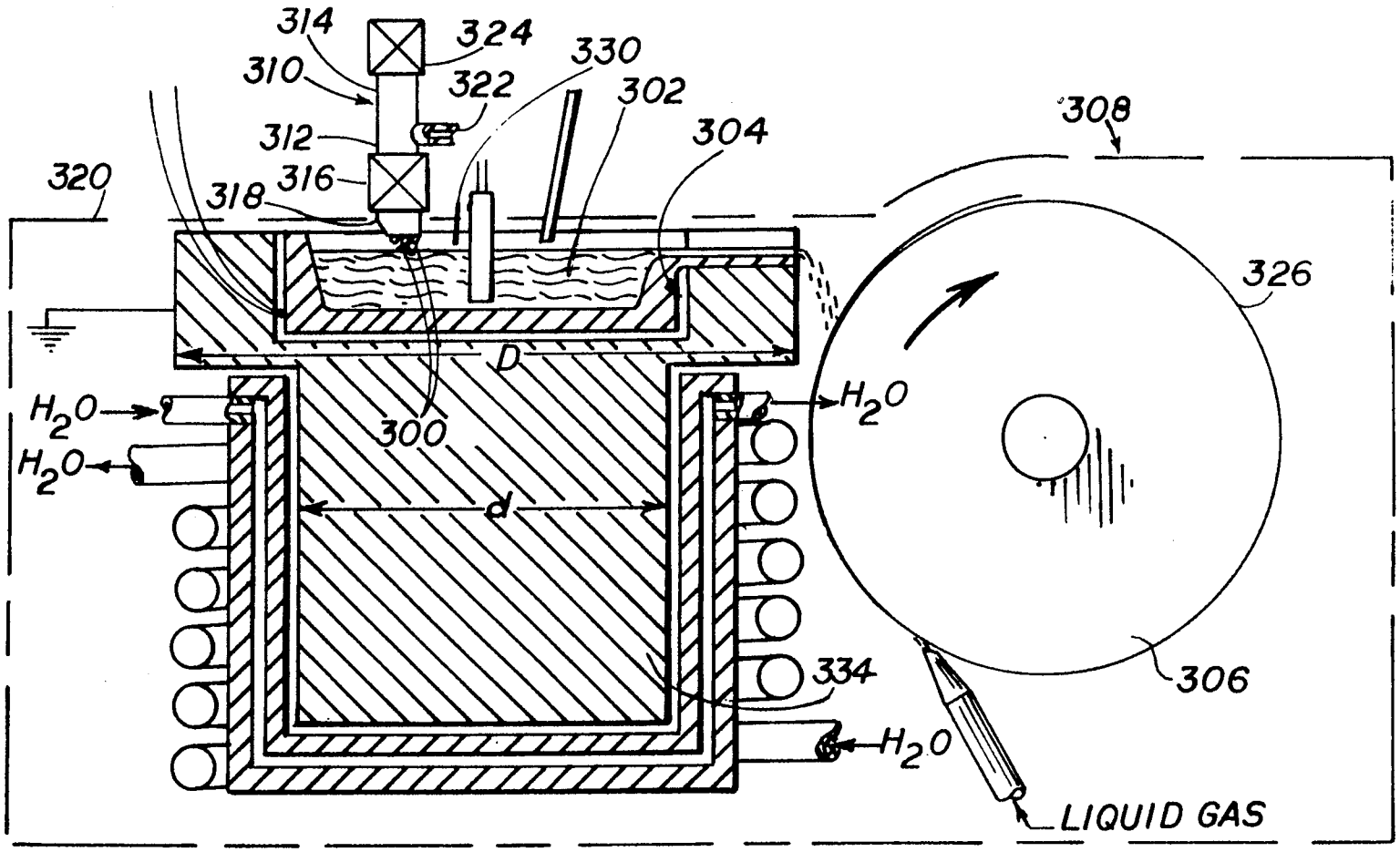
FIG. 5 is a schematic representation of a preferred means for providing solid feed stock to replenish the molten metal spilled from the pool. A cooled wheel is employed onto which the molten metal is spilled.

FIG. 5 illustrates a preferred means for providing feed stock 300 into molten pool 302 which is contained in a crucible 304. The molten pool 302 spills onto a casting wheel 306. A vessel 308 shown in phantom line is provided in which a controlled atmosphere can be maintained to shroud the molten pool 302 and the wheel 306 provides a protective environment in which the metal is solidified. The means for providing feed stock has a substantially vertical chamber 310 having a first end 312 and a second end 314. A first valve 316 is attached to the first end 312 of the vertical chamber 310. A shoot 318 attaches to the first valve 316 and passes through the vessel wall 320. The shoot 318 extends into the vessel 308 terminating over the molten bath 302. A gas passage 322 is provided to the chamber 310 between the first end 312 and the second end 314 for purging the chamber 310. Preferably the gas passage 322 is positioned near the first value 316 to aid in purging the chamber 310. A second valve 324 attached to the second end 314 of the chamber 310 is provided for closing the chamber after the solid feed material has been added and the chamber 310 has been purged of air. The first valve 316 is then opened to allow the charge to pass down the shoot 318 and into the molten bath 302, thereby raising the level and causing the molten material to be spilled onto the moving rim 326 of the casting wheel 306.

By regulation of the opening and closing of the first valve 316 the variation of the molten metal of the bath 302 can be controlled. The control means illustrated in FIG. 5 consists of an electrically conductive probe 330 which is positioned at a predetermined depth in the crucible 304 in the inductor 334 and is electrically isolated from the inductor 334. When the molten bath 302 contacts the probe 330, the probe is grounded and a conductive path established. This conductive path is employed to activate a feed means. For the means of FIG. 5 the conductive path is employed to close a circuit and to activate a valve closing mechanism which closes the first valve 316 thereby stopping the addition of feed stock to the molten bath 302. When the molten bath level drops such that the probe 330 no longer contacts the molten bath 302 the conductive path will be broken and the valve will again open, allowing the addition of feed stock 300.

Figure 6:
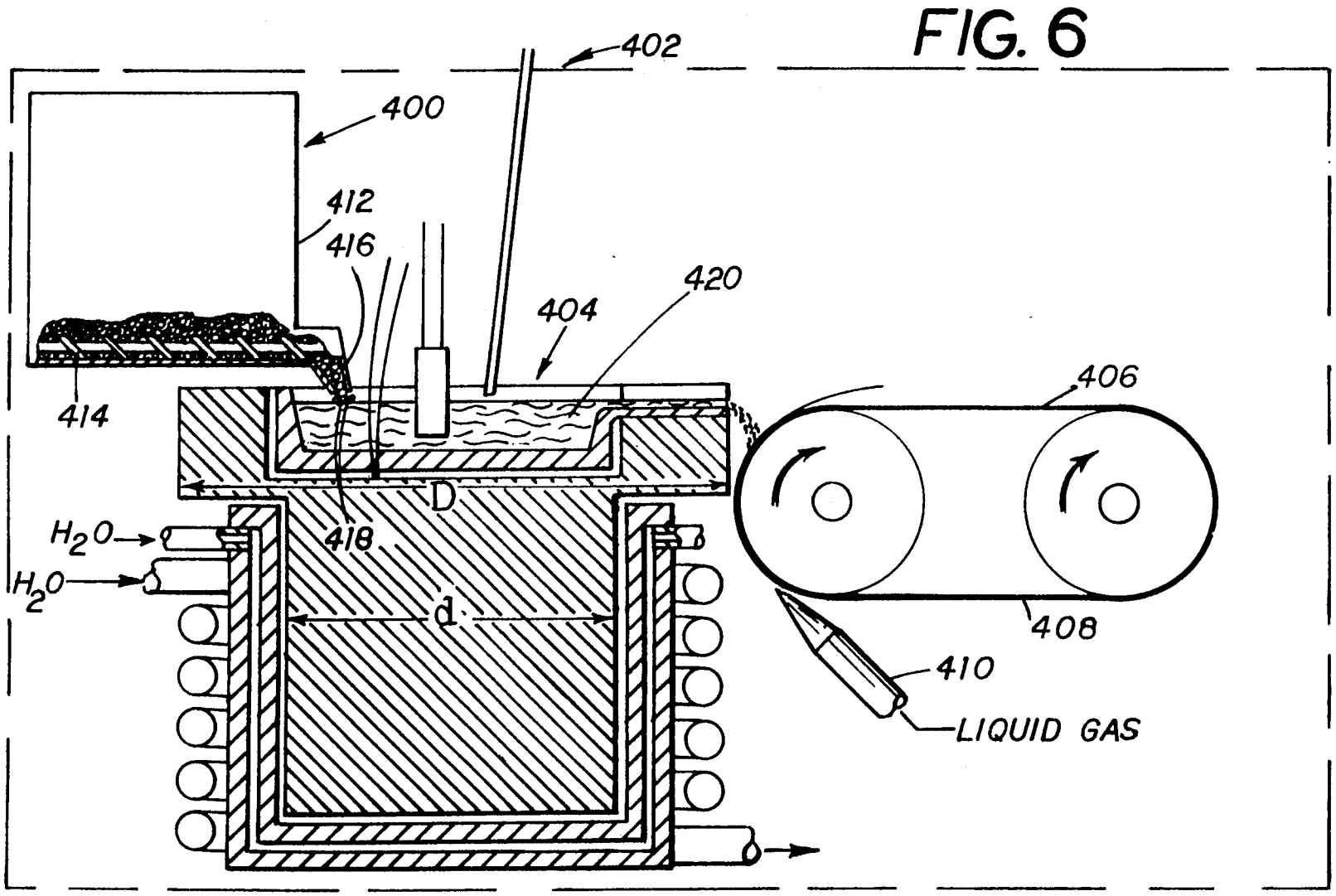
FIG. 6 is a schematic representation of another preferred embodiment for the feed mechanism and employes a cooled belt onto which the molten metal is spilled.

FIG. 6 illustrates another preferred embodiment for means to advance the solid feed stock. Again this means is designed to feed particulate feed material to a molten pool. The means for providing solid feed material 400 is contained in a vessel 402 which encloses the crucible 404 and a moving chill surface 406. The moving chill surface illustrated in FIG. 6 is a metal belt 408 which rotates, as shown by the arrows, to provide motion to the moving chill surface 406. This moving chill surface 406 is preferably cooled with liquid gas with a nozzle 410 which directs liquid gas onto the chill surface 406 of the casting belt 408.

A hopper or bin 412 for holding pelletized feed stock is positioned in the vessel 402. Preferably a screw drive 414 turned by a motor not shown, is employed to advance pelletized feed stock into a shoot 416 which is positioned to feed the pellets 418 to the molten pool 420. The pellets 418 are added to a molten pool 420 which is contained in the crucible 404 as the pool 420 overflows the crucible and spills onto the moving chill surface 408 where it is rapidly solidified. The rate of spill can be controlled by either providing a constant rate of advance of the feed mechanism or alternatively, by using a control means such as the probe illustrated in FIG. 5. The probe will intermittently activate a motor which drives the screw driver 414 and feeds the feed pellets 418 to the molten pool 420.

The present invention has been described in terms of preferred embodiments and particular configurations. Modifications to the apparatus including substitution of materials from those suggested in the application can be made by one skilled in the art without departing from the spirit of the invention.

What I claim is:

1. An apparatus for melting and forming a rapidly solidified material from solid feed material comprising:

a) an inductor having a first section and a second section, said first section having a cavity forming a crucible;

b) an induction coil positioned around said second section of said inductor;

c) means for providing feed stock into said crucible;

d) a focused energy source for directing energy into said cavity for locally melting said feed stock and forming a skulled melt having a molten pool contained therein;

e) means for monitoring and controlling the temperature at a skull crucible interface being defined by the interface between said skull and said crucible; and f) a moving casting surface positioned at a separation such that the chill surface accepts a stream resulting from the overflow which results from the addition of feed stock.

2. The apparatus of claim 1 further comprising:

g) a vessel enclosing said crucible and said moving casting surface; and h) a water cooled crucible for containment of the inductor for shielding said chill surface from radiational heating by said inductor.

3. The apparatus of claim 2 wherein:

said focused energy source is selected from the group of energy sources consisting of lasers, arc torches, and plasma torches; and said means to maintain means the temperature further comprises a thermal couple positioned at said skull crucible interface and a controller responsive to said thermocouple which regulates the power supplied to said induction coil such that the temperature at said skull crucible surface is between about 0.7 and 0.95 Tm, where Tm is defined as the melting or solidus temperature.

4. The apparatus of claim 3 wherein said means to advance said solid feed stock comprises:

a substantially vertical chamber having an upper and lower end;

a first valve for closing said first end of said chamber;

a shoot attached to said first valve and passing into said vessel for directing said solid feed stock into said molten pool;

a second valve for closing said second end of said chamber; and a gas passage onto said chamber to supply gas for purging said chamber.

5. The apparatus of claim 4 wherein said molten pool has a depth, said depth being maintained by pool sensing means which regulate said closing of said first valve.

6. The apparatus of claim 3 wherein said means to advance said solid feed stock comprises:

a bin positioned in said vessel for said feed material which is in solid pellets form, said bin having a shoot attached thereto, said shoot being positioned to provide said solid pellets to said molten pool; and a screw feed mechanism housed in said bin for advancing the solid pellets from said bin into said shoot.

7. The apparatus of claim 4 wherein said molten pool has a depth, said depth being maintained by pool sensing means which regulate said screw feed mechanism.

8. The apparatus of claim 5 further comprising a dam which divides said molten pool into a first section into which said solid metal is fed and a second section from which molten metal overflows said molten pool.

9. The apparatus of claim 7 further comprising a dam which divides said molten pool into a first section into which said solid metal is fed and a second section from which molten metal overflows said molten pool.

10. The apparatus of claim 3 wherein said chill surface is the rim of a wheel.

11. The apparatus of claim 10 further comprising means for cooling said wheel.

12. The apparatus of claim 11 wherein said means for cooling comprises; a source of liquid gas; and at least one nozzle for directing said liquid gas onto said rim of said wheel.

13. The apparatus of claim 3 wherein said chill surface is a metal belt.

14. The apparatus of claim 13 further comprising means for cooling a belt.

15. The apparatus of claim 14 wherein said means for cooling comprises; a source of liquid gas; and at least one nozzle for directing said liquid fed gas onto said moving chill surface.

* * * * *